US006641379B1

(12) United States Patent
Dewar et al.

(10) Patent No.: US 6,641,379 B1
(45) Date of Patent: Nov. 4, 2003

(54) LOAD BEARING RIBS FOR FIXED SCROLL

(75) Inventors: Todd W. Dewar, Abingdon, VA (US); Tracy Lanier Milliff, Bristol, VA (US); John R. Williams, Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/125,076

(22) Filed: Apr. 18, 2002

(51) Int. Cl.[7] ..... F04C 18/04
(52) U.S. Cl. ..... 418/55.2
(58) Field of Search ..... 418/55.2

(56) References Cited

U.S. PATENT DOCUMENTS 5,474,431 A * 12/1995 Fairbanks ..... 418/55.2
5,478,219 A * 12/1995 Nardone et al. ..... 418/55.2
5,857,844 A * 1/1999 Lifson et al. ..... 418/55.2

FOREIGN PATENT DOCUMENTS

EP 545847 A1 * 6/1993 ..... F04C/15/04
JP 01063683 A * 3/1989 ..... F04C/18/02
JP 11148470 A * 6/1999 ..... F04C/18/02

OTHER PUBLICATIONS

The Development of Highly Reliable and Efficient Scroll Compressors by Kenji Matsuba, Shigeki Hagiwara, Toshiaki Yoshii, Hiroyuki Kuroiwa, Keiji Yoshimura, Kazuhiko Matsukawa.
Kazutaka Hori, Daikin Industries, Ltd., Compressor Development and Engineering Center, 3–12 Chikko—Shinmachi, Sakai, Osaka, 592 Japan.

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor includes a non-orbiting scroll having a plurality of radially extending ribs on its rear face. The non-orbiting scroll preferably provides a separating function separating the interior of the sealed housing of the compressor into the discharge and suction pressure chambers. The ribs extend from a central portion of the base of the non-orbiting scroll to its outer peripheral surface. A circumferentially extending rib also connects the plural radially extending ribs.

12 Claims, 3 Drawing Sheets

LOAD BEARING RIBS FOR FIXED SCROLL

BACKGROUND OF THE INVENTION

This invention relates to a scroll compressor having a non-orbiting scroll with load bearing ribs.

Modem refrigerant compressors are often mounted within a sealed container. In these compressors, the pump unit for compressing the refrigerant is positioned at one end, and a motor for driving the pump unit is positioned at another end. Often the suction pressure refrigerant is allowed to circulate over the motor, cooling the motor. In such compressors, it becomes necessary to separate a suction pressure chamber from a discharge pressure chamber.

One popular type of modern compressor is a scroll compressor. A scroll compressor includes a pair of scroll members each having a base and a generally spiral wrap extending from the base. The wraps of the two scroll members interfit to define compression chambers. One of the scroll members is driven to orbit relative to the other, and during this orbital movement, the compression chambers decrease in volume.

In traditional scroll compressors, the non-orbiting scroll does not seal against the compressor housing. Instead, a separate separator plate is positioned typically outwardly of the base of the non-orbiting scroll to separate the housing into the suction and discharge pressure chambers. Most typically, a discharge pressure chamber is formed above the separator plate, and the area below the separator plate is at suction pressure.

More recently, it has been proposed to incorporate the separator function into the base of the non-orbiting scroll. In such compressors, the base of the non-orbiting scroll is sealed to the housing. Thus, there is the discharge pressure chamber on one side of the base of the non-orbiting scroll and the suction pressure chamber on the other.

In such compressors, compressed refrigerant often reaches relatively high pressures. With the above discussed recent scroll compressor improvements, this high pressure may cause the scroll base to deform toward the suction side of the compressor. This deformation is undesirable.

One proposed design employs ribs extending radially from the center of scroll base across a limited portion of the base. This design may not offer sufficient support to the base. Moreover, the design only offers support along a radial path from the base's center.

A need therefore exists for a scroll base having greater support against deflection and deformation.

SUMMARY OF THE INVENTION

In a disclosed embodiment of this invention, a scroll compressor has an orbiting scroll member and a non-orbiting scroll member. The non-orbiting scroll is utilized to separate a housing containing both scroll members into suction and discharge pressure chambers. Preferably, the non-orbiting scroll has an outer peripheral surface sealed to a inner peripheral surface of the housing defining the suction and discharge pressure chambers. Other ways of sealing the non-orbiting scroll to the housing may be used. To limit deflection of the non-orbiting scroll, ribs are formed on the outer face of the base of the scroll member. The ribs preferably offer support along a radial and non-radial path from the center and may extend across the entire scroll member.

The ribs preferably extend from a center portion of the non-orbiting scroll member to the periphery of the member.

The extension of ribs to the periphery permits the distribution of load caused by the pressure differential between the discharge pressure chamber and the suction pressure chamber across the entire member. In addition, a rib is preferably formed along the periphery to provide further support. This peripheral rib intersects the ribs extending from the center portion. The radially extending ribs meet in the center portion and connect to a boss of the non-orbiting scroll member. The non-orbiting scroll member typically has a circular outer peripheral shape.

The ribs preferably form a radial design extending from the center portion of the base. In addition, the invention envisions the use of ribs so as to distribute loads not only radially but in a non-radial fashion across the non-orbiting scroll member. Alternate rib embodiments crisscross and intersect each other to distribute load across other portions of the non-orbiting scroll member. Some rib embodiments intersect at perpendicular angles.

The present invention accordingly permits the non-orbiting member to be supported by ribbing and avoid deflections and deformities caused by their absence, thereby providing greater support to the non-orbiting member.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
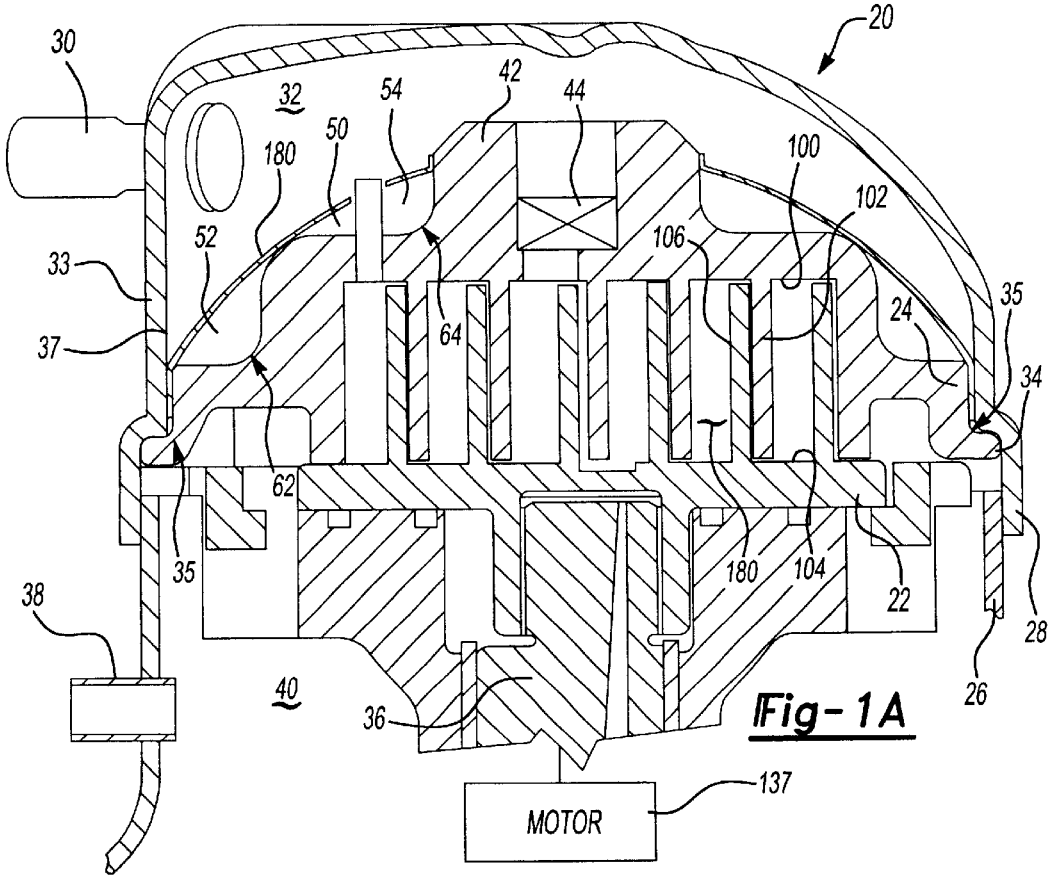
FIG. 1A illustrates a cross sectional view of the invention, including a scroll member with ribs.

A scroll compressor 20 is illustrated in FIG. 1A. As known, scroll compressor incorporates an orbiting scroll 22 and a non-orbiting scroll 24. A center shell 26 is secured to an upper shell 28. A discharge pressure chamber 32 is defined within upper shell 28, discharging refrigerant through tube 30. Non-orbiting scroll 24 has a base 100 and a spiral wrap 102 extending from the base. The orbiting scroll 22 similarly has a base 104 and a spiral wrap 106. Compression chambers 108 are defined between the two wraps.

In the non-orbiting scroll 24, the base is sealed to periphery 35 of the upper shell 28. The base itself can form a seal, or a separate seal element can be used. A shaft 36 is driven by motor 137 to drive the orbiting scroll 22. A suction tube 38 extends through the center shell 26 to supply refrigerant to chamber 40. As can be seen, suction tube 38 is positioned on a side of orbiting scroll 22 remote from non-orbiting scroll 24. The sealing joint between the base of non-orbiting scroll 24 and the upper shell 28 divides the interior of the housing into the discharge pressure chamber 32 and the suction pressure chamber 40.

Boss 42 on base receives a check valve assembly 44, shown schematically. Refrigerant is compressed between the orbiting and non-orbiting scrolls 22 and 24 and passes through check valve 44 into chamber 32. Refrigerant in discharge pressure chamber 32 is at high pressure while suction pressure chamber 40 is at low pressure. The difference in pressure may cause non-orbiting scroll to deflect or deform toward suction pressure chamber 40. High temperature of the non-orbiting scroll may also cause deformation.

Figure 1B:
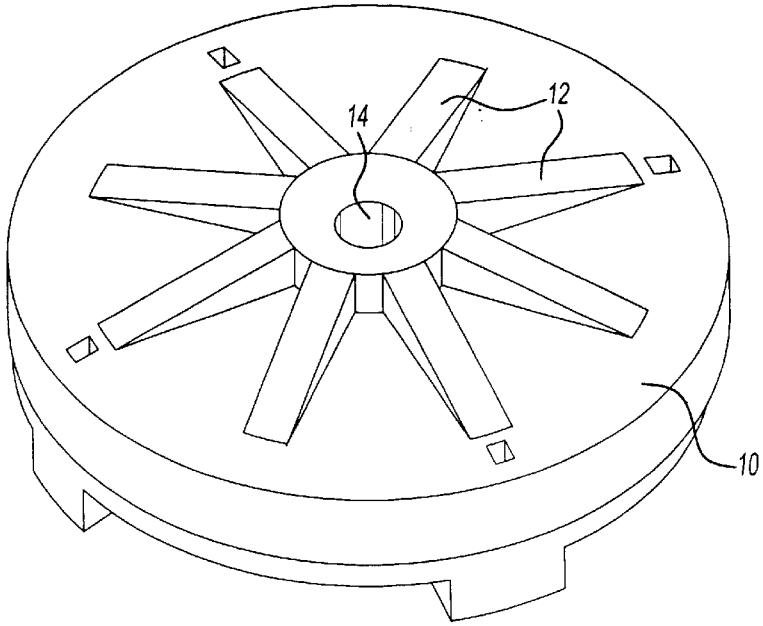
Fig-1B PRIOR ART
FIG. 1B shows a prior art scroll member.

FIG. 1B illustrates a prior art design. Shown is non-orbiting scroll member 10 with ribs 12 extending from center 14 along a radial direction. As shown in this figure, ribs 12 extend only across a limited portion of non-orbiting scroll member 10. Thus, scroll member 10 is supported only across this portion along a radial path from center 14.

To increase support, the inventive non-orbiting scroll member 24 is reinforced by several ribs 50, extending from boss 42 to about periphery 37. Periphery 37 meets wall 33 of upper shell 28 as shown. In this way, ribs 50 provide support against deflection from boss 42 to periphery 37 across the great majority of member 24. Each rib 50 has first portion 52 extending above land 62 of base 100 and second portion 54 extending above land 64 of base 100, reinforcing both areas to prevent deflection of base 100. As shown, land 64 is elevated relative to land 62 essentially by a circumferentially extending portion, or rib 180.

Figure 2:
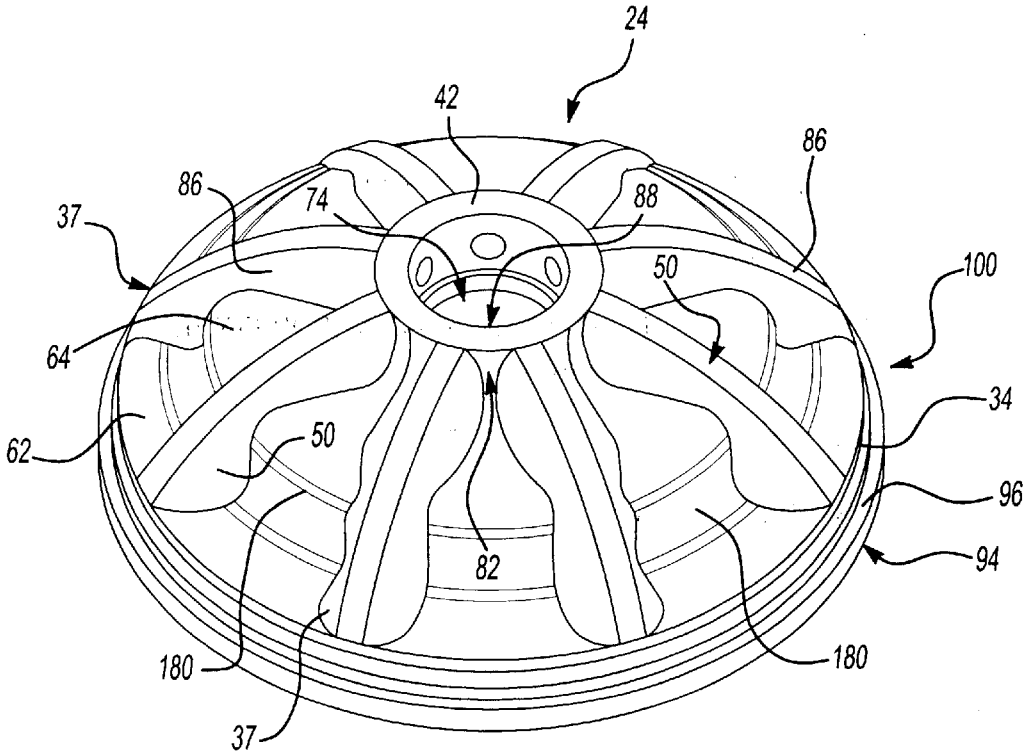
FIG. 2 illustrates the FIG. 1A non-orbiting scroll member.

FIG. 2 illustrates the non-orbiting scroll employing the inventive features of this invention. Boss 42 is located in a center portion of non-orbiting scroll 24. Boss 42 has passage 74 to permit the communication of refrigerant between the compression chamber and the discharge pressure chamber. Non-orbiting scroll 24 comprises base 100, which itself comprises land 62, land 64 and central portion 82. Land 62 encircles land 64, which encircles boss 42. Moreover, as shown in this figure, land 64 is elevated above land 62 and shares circumferential rib 180, which provides the elevated position of land 64 with respect to land 62. Boss 42 may be elevated above both land 62 and land 64. Supporting base 100 further are radial ribs 50, which may extend from center point 88 to about periphery 37. Periphery 37 is positioned inwardly of outer periphery 94. Periphery 37 is elevated above outer periphery 94 to form a circumferential lip 34 which may abut upper shell 28 as shown in FIG. 1.

Figure 3:
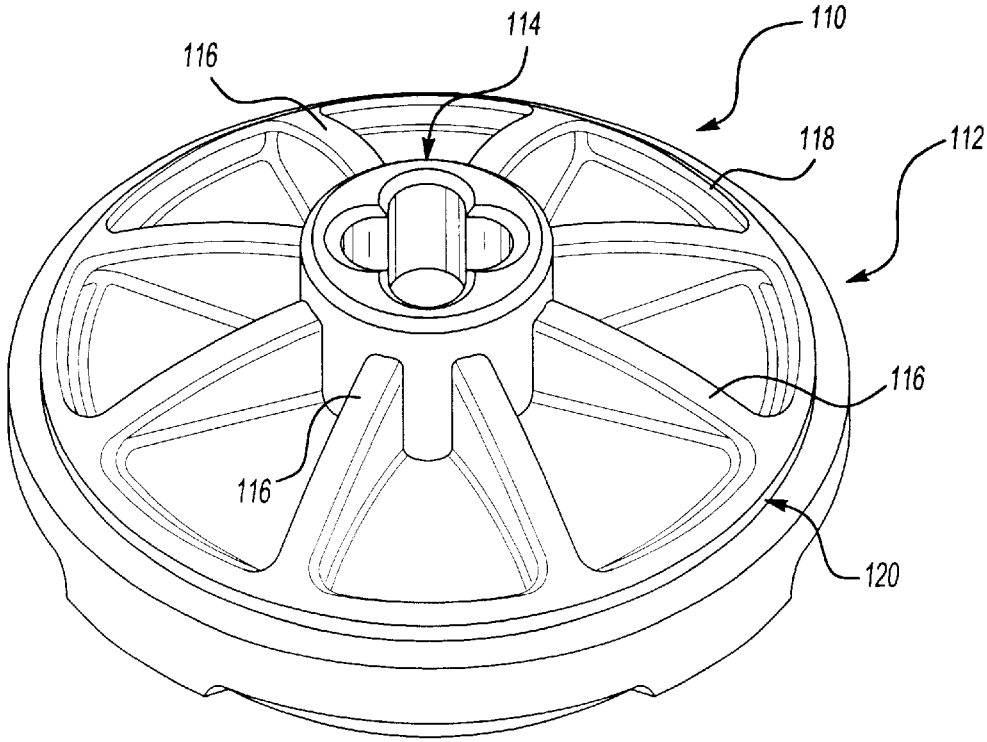
FIG. 3 illustrates another embodiment non-orbiting scroll member

FIG. 3 illustrates another non-orbiting scroll 110 having base 112, boss 114 and ribs 116 radiating from boss 114. This particular design also employs rib 118 extending circumferentially around periphery 120 of base 112. Rib 118 may provide additional support to base 112 and intersect radial ribs 116. Moreover, rib 118 may form part of the sealing surface for an upper shell of a sealed housing.

Figure 4:
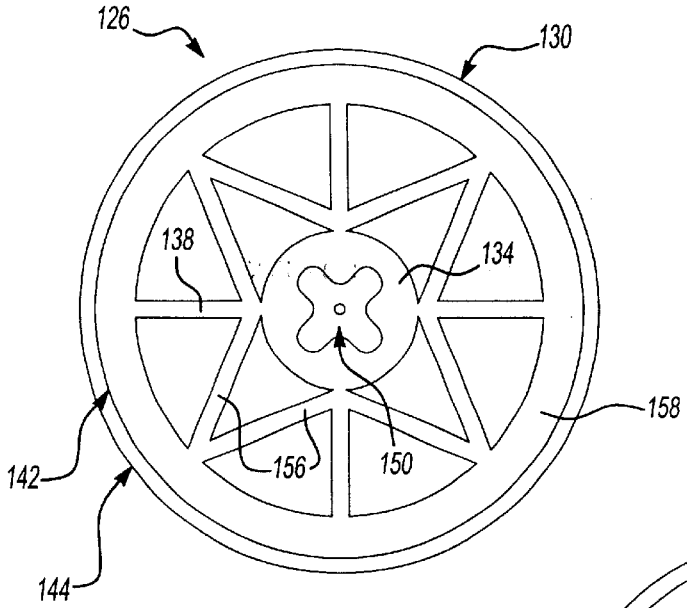
FIG. 4 shows another non-orbiting scroll member with radial ribs.
Figure 5:
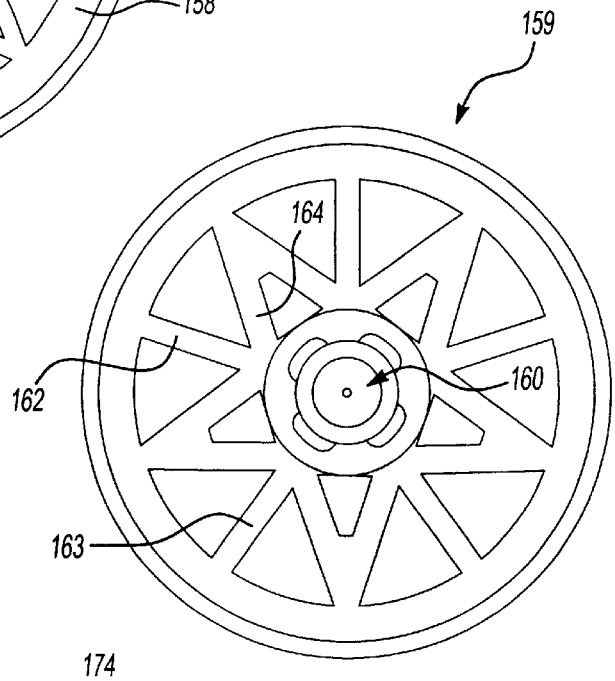
FIG. 5 illustrates another non-orbiting scroll member with non-radial and radial ribs.
Figure 6:
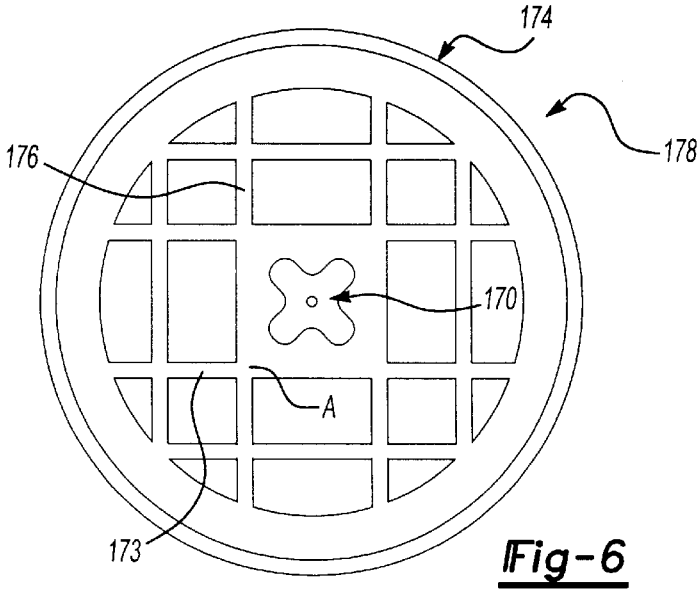
FIG. 6 illustrates a non-orbiting scroll member with ribs, a waffle pattern rib design.

FIGS. 4, 5 and 6 illustrate other rib patterns. FIG. 4 shows non-orbiting scroll 126 with base 130 and boss 134. Base 130 is reinforced by ribs, such as rib 138, extending radially from boss 134 to inner periphery 142. Inner periphery 142 is within outer periphery 144.

In addition, base 130 may be reinforced by non-radial ribs such as rib 156, which extends along a path that does cross center 150. Rib 156 may extend transversely from rib 138, a radial rib. Rib 158 is also provided, extending circumferentially about inner periphery 142 and may intersect rib 138 and rib 156. In this way, the invention provides support radially and non-radially across base 130, distributing load over, through and around center 150.

FIG. 5 illustrates another non-orbiting scroll 159 having center point 160 and ribs 162 and 163 radiating from center point 160. Here, rib 164 is formed that is transverse to ribs 162 and 163 and does not pass through center point 160.

FIG. 6 illustrates a waffle pattern design, highlighting again the non-radial rib feature of the invention. Rib 176 extends across base 174 of non-orbiting scroll 178 along a path that does not extend through center 170. Another non-radial rib 173 may intersect rib 176 perpendicularly at point A. One of ordinary skill in the art can envision other ways to employ both radial and non-radial ribs to support a non-orbiting scroll to avoid deformation and its deflection.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A scroll compressor comprising:

a sealed housing;

a first scroll member having a base and a generally spiral wrap extending from said base, a seal between said base and said housing to define a discharge pressure chamber on a first side of said base, and a suction pressure chamber on a second side of said base;

a second scroll member having a base and a generally spiral wrap extending from said base, said wraps of said first and second scroll members interfitting to define compression chambers;

a motor for driving said second scroll member to orbit relative to said first scroll member; and wherein said base of said first scroll member comprises a center portion and a periphery and wherein plural ribs extend to about said periphery on said first side, said plural ribs extending to about said seal.

2. The scroll compressor of claim 1 wherein said plural ribs extend radially from said center portion of said base of said first scroll.

3. The scroll compressor of claim 1 including a boss having a path to communicate a refrigerant between said compression chambers and said discharge pressure chamber wherein said plural ribs extend from said boss to about said periphery.

4. A scroll compressor comprising:

a sealed housing;

a first scroll member having a base and a generally spiral wrap extending from said base, a seal between said base and said housing to define a discharge pressure chamber on a first side of said base, and a suction pressure chamber on a second side of said base;

a second scroll member having a base and a generally spiral wrap extending from said base, said wraps of said first and second scroll members interfitting to define compression chambers;

a motor for driving said second scroll member to orbit relative to said first scroll member;

wherein said base of said first scroll member comprises a center portion and a periphery and wherein plural ribs extend to about said periphery on said first side; and a circumferentially extending rib intersecting said plural ribs.

5. The scroll compressor of claim 2 wherein said circumferentially extending rib extends at least partially along said periphery and intersects said plural ribs at said periphery.

6. The scroll compressor of claim 2 wherein said circumferentially extending rib is at a radially intermediate point, creating radially outer and radially inner portions of each of said plural ribs.

7. A scroll compressor comprising:

a sealed housing;

a first scroll member having a base and a generally spiral wrap extending from said base, a seal between said base and said housing to define a discharge pressure chamber on a first side of said base, and a suction pressure chamber on a second side of said base;

a second scroll member having a base and a generally spiral wrap extending from said base, said wraps of said first and second scroll members interfitting to define compression chambers;

a motor for driving said second scroll member to orbit relative to said first scroll member;

wherein said base of said first scroll member comprises a center portion and a periphery and wherein plural ribs extend to about said periphery on said first side; and wherein said plural ribs extending to about said periphery comprises at least a first rib and a second rib, said first rib extending along a path transverse to said second rib.

8. The scroll compressor of claim 7 wherein said first rib extends along a path generally orthogonal to said second rib.

9. A scroll compressor comprising:

a sealed housing;

a first scroll member having a base and a generally spiral wrap extending from said base, a seal provided between said base and said housing to define a discharge pressure chamber on a first side of said base, and a suction pressure chamber on a second side of said base, said base of said first scroll member comprising a center point; a second scroll member having a base and a generally spiral wrap extending from said base, said wraps of said first and second scroll members interfitting to define compression chambers;

a motor for driving said second scroll member to orbit relative to said first scroll member; and a plurality of radially extending ribs extending from a central boss, said central boss communicating said compression chambers to said discharge chamber, said radially extending ribs extending from said boss to an outer peripheral surface on said first side of said base of said first scroll member, and a circumferentially extending rib connecting said plural radially extending ribs.

10. The scroll compressor of claim 9 wherein said circumferentially extending rib extends at least partially along said outer peripheral surface and intersects said plurality of radially extending ribs at said outer peripheral surface.

11. The scroll compressor of claim 9 wherein said circumferentially extending rib is at a radially intermediate point, creating outer and radially inner portions of each of said plurality of radially extending ribs.

12. The scroll compressor of claim 9 wherein said circumferentially extending rib comprises a plurality of ribs at least one rib extending at least partially along said outer peripheral surface and another rib spaced between said outer peripheral surface and said central boss.

* * * * *